US007534153B2

(12) United States Patent
Koelling et al.

(10) Patent No.: US 7,534,153 B2
(45) Date of Patent: May 19, 2009

(54) SURFBOARD MANUFACTURING APPARATUS

(75) Inventors: Fred Koelling, Foster City, CA (US); Venugopal Subramanyam, Freemont, CA (US)

(73) Assignee: B4 Custom, La Jolla, CA (US)

( * ) Notice: Subject to any disclaimer, the term of this patent is extended or adjusted under 35 U.S.C. 154(b) by 59 days.

(21) Appl. No.: 11/655,651

(22) Filed: Jan. 19, 2007

(65) Prior Publication Data

US 2007/0173145 A1 Jul. 26, 2007

Related U.S. Application Data

(60) Provisional application No. 60/760,855, filed on Jan. 20, 2006.

(51) Int. Cl.
*B63B 35/81* (2006.01)
*B27C 5/00* (2006.01)

(52) U.S. Cl. ..... 441/74; 144/144.1

(58) Field of Classification Search ..... 441/74
See application file for complete search history.

(56) References Cited

U.S. PATENT DOCUMENTS 3,468,353 A * 9/1969 Okey ..... 144/144.1
5,830,025 A 11/1998 Fleming

OTHER PUBLICATIONS

Pirsch, Stephen. How to Build Your First Surfboard. Copyright 2003. Jan. 4, 2006. 59 pages. <surfersteve.com/introduction.htm>.
Parmenter, Dave. A Surfboard Anatomy. Copyright 2000. Jan. 4, 2006. 27 pages. <surfline.com/mag/features/anatomy/anatomy_textonly.html>.
Earnest, Leslie. "Tide Turns for Foam Factory." New York Times Dec. 31, 2005: 4 pages.
Author Unknown. "How to Buy a Surfboard." Copyright 2000-2002. Jan. 4, 2006. 2 pages. <website address unknown>.

* cited by examiner

*Primary Examiner*—Jesus D Sotelo
(74) *Attorney, Agent, or Firm*—Stetina Brunda Garred & Brucker

(57) ABSTRACT

A surfboard manufacturing machine for fabricating a surfboard is disclosed. The machine may comprise gripper arms and suction arms which rotate and grip the surfboard blank or shaped surfboard as the surfboard manufacturing machine fabricates the surfboard.

15 Claims, 12 Drawing Sheets

SURFBOARD MANUFACTURING APPARATUS

CROSS-REFERENCE TO RELATED APPLICATIONS

This application claims the benefits of Provisional Patent Application No. 60/760,855, filed on Jan. 20, 2006, the entire contents of which is incorporated herein by reference.

STATEMENT RE: FEDERALLY SPONSORED RESEARCH/DEVELOPMENT

Not Applicable

BACKGROUND

The present invention relates generally to a surfboard manufacturing apparatus, and more particularly, a surfboard retail vending machine that may be useful for manufacturing a customized or selected surfboard while a purchasers waits at a retail store.

End users of surfboards have two methods of purchasing a surfboard. The first method is to purchase a pre-made surfboard from a local surf shop. The end user will visit a local surf shop which may carry many different types of boards such as long boards, short boards, big wave guns, hybrids, etc. Within each of the different types of boards, there are a variety of different selections that the end user may select depending on the end user's personal taste, skill, type of wave to be ridden, etc. For example, the weight of the board, width and thickness, rocker, fin position and number, etc. Unfortunately, the local surf shop would not be capable of economically storing at the retail premises each and every combination to accommodate all end users. Accordingly, the end user must settle for a board that may be close to the end user's preference but not exactly matched to the end user's preferred type of board.

In the alternative, the end user may order a custom-made surfboard from a surfboard shaper or manufacturer. The advantage of ordering a custom-made surfboard is that the end user is able to obtain a surfboard that is matched to the end user's preferred board weight, width, thickness, rocker, fin position and number, etc. as well as other numerous surfboard design considerations. The disadvantage of ordering your custom-made surfboard is that the end user must wait a several weeks for the surfboard shaper/manufacturer to make his/her surfboard.

Accordingly, there is a need in the art for a surfboard manufacturing apparatus, and an improved method of providing custom made surfboards to end users.

BRIEF SUMMARY

The surfboard vending machine discussed herein addresses the problems identified above, below and those that are known in the art. The surfboard vending machine is comprehensive surfboard manufacturing unit such that a technician who does not know how to shape and fabricate a board manually can do so after being trained to use the surfboard vending machine.

The surfboard vending machine may have a plurality of surfboard shapes for different surfing conditions. The purchaser may enter his/her personal information (e.g., payment info, height, weight, riding preferences, etc.) as well as the type of waves the purchaser expects to ride. The surfboard vending machine may compile the inputted information and provide the purchaser with a suggested surfboard having specific shapes customized to the purchaser's inputted information. The purchaser is provided an option to change the computer suggested surfboard shape. Also, the purchaser may have the option to select a board shape form a library of board shapes. After the surfboard shape is finalized, the surfboard vending machine may prompt a technician to load the surfboard vending machine with a surfboard blank.

After the surfboard vending machine is loaded with the surfboard blank, a machining head of the surfboard vending machine mills out or shapes the surfboard blank into the surfboard shape finalized by the purchaser. Also, the surfboard vending machine coats (i.e., forms a shell or skin over the surfboard blank) and applies graphics to the surfboard. The technician may inspect the surfboard and present the customized surfboard to the purchaser.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
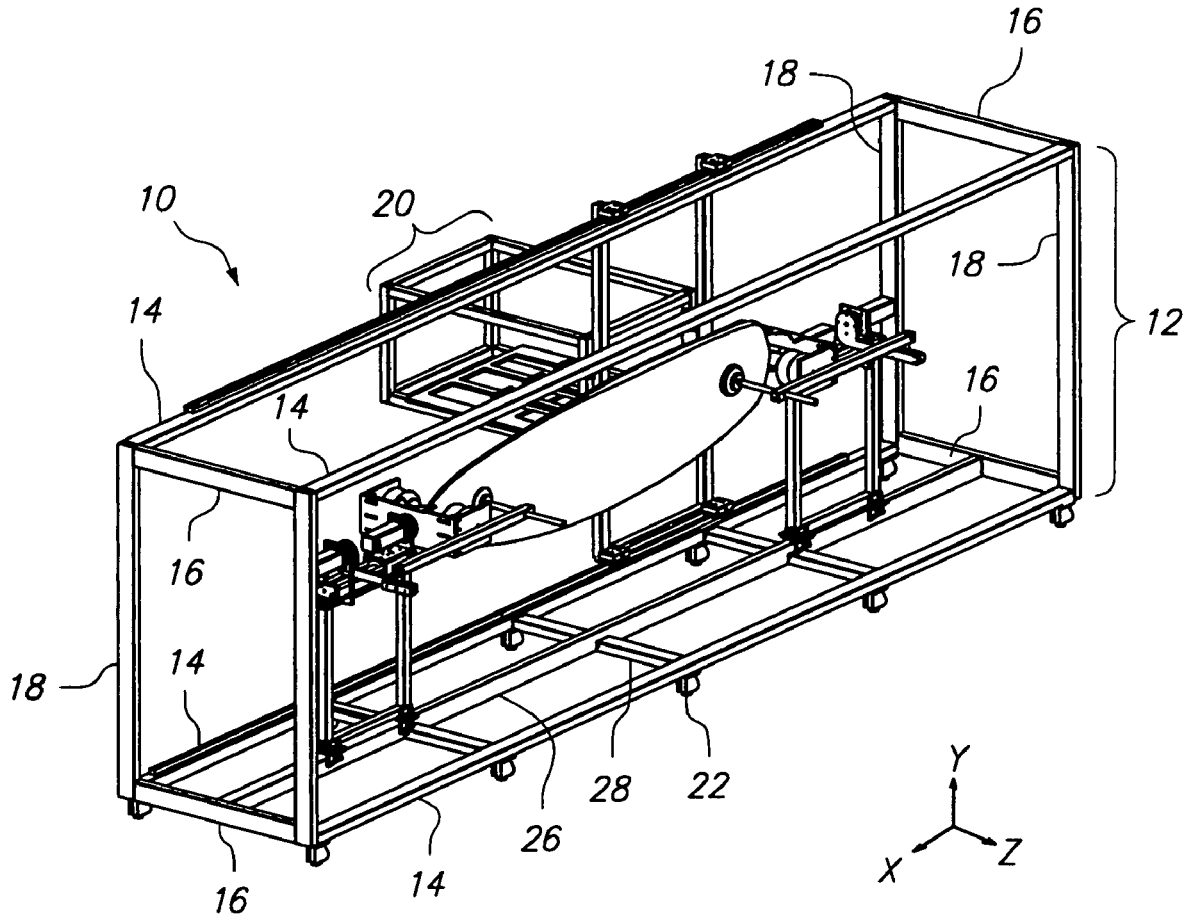
FIG. 1 is a front perspective view of a surfboard vending machine.
Figure 2:
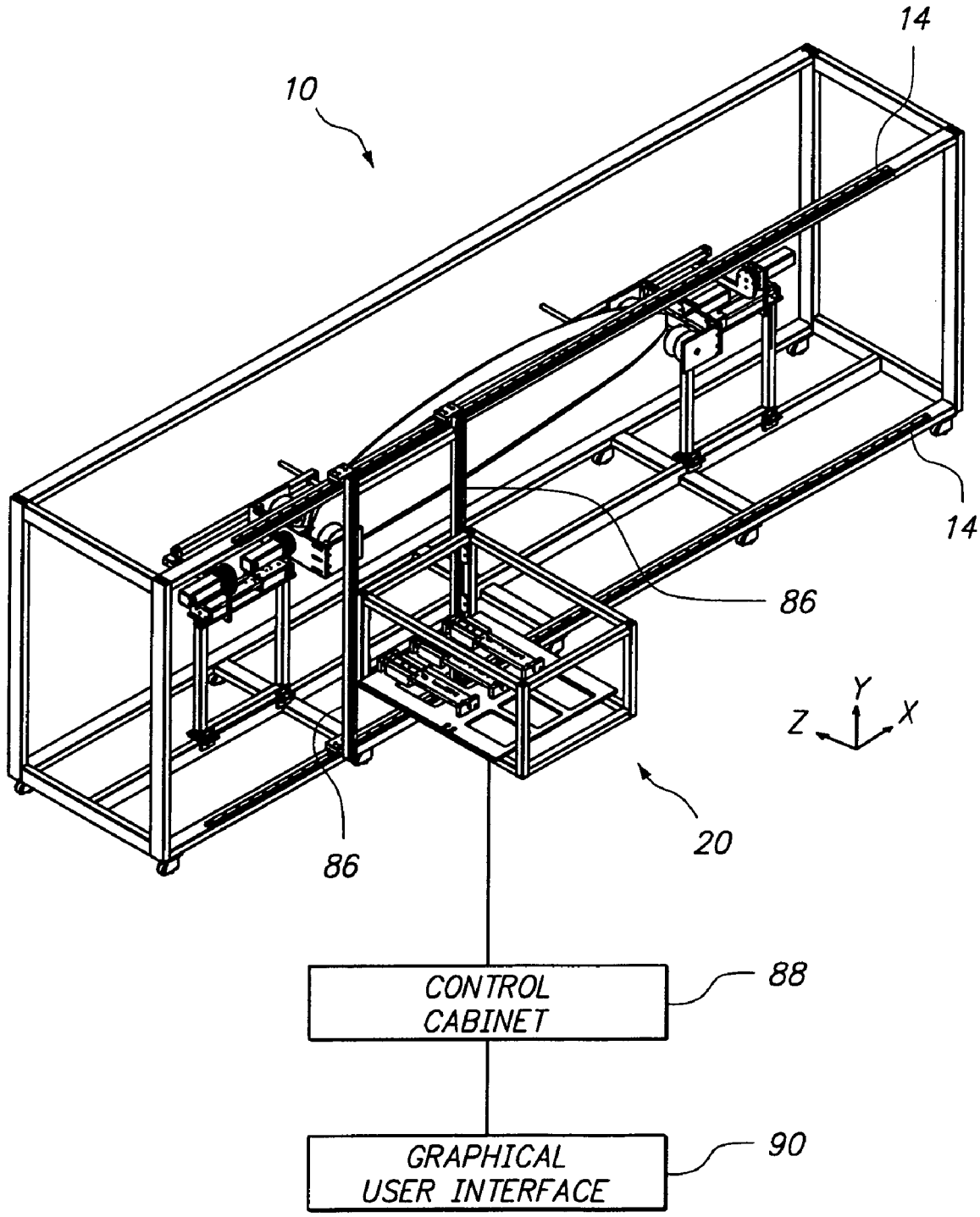
FIG. 2 is a rear perspective view of the surfboard vending machine.
Figure 3:
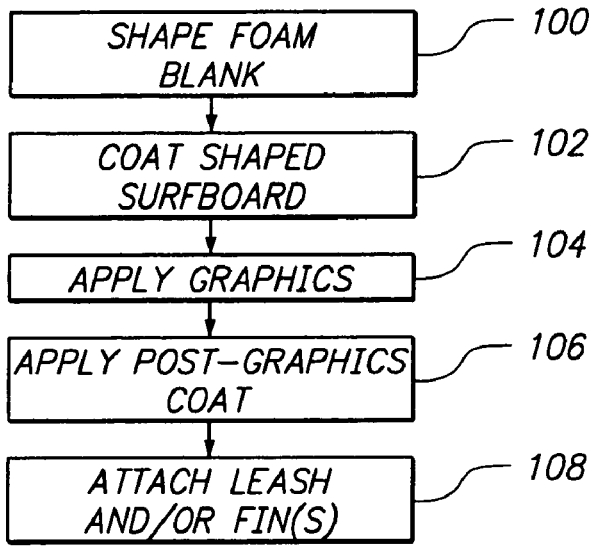
FIG. 3 is a flow diagram of a method of fabricating a surfboard with the surfboard vending machine.

Referring now to the figures which are for the purposes of illustrating a surfboard vending machine 10 and not for the purposes of limiting the surfboard vending machine 10 to the embodiments disclosed herein, FIGS. 1 and 2 respectively illustrate front and rear perspective views of the surfboard vending machine 10. As shown in FIG. 3, the surfboard vending machine 10 is operative to shape 100 a foam blank, coat 102 the shaped surfboard, apply (e.g., print, etc.) graphics 104 onto the exterior of the coated surfboard, and apply a post-graphics spray coating 106 to the printed surfboard, as shown in FIG. 3. A technician may attach 108 a leash and a fin to the surfboard to finish the surfboard and present the finished surfboard to the end user.

As shown in FIGS. 1 and 2, the surfboard vending machine 10 may have a main frame 12 which may comprise a plurality of extruded aluminum members. In particular, the main frame 12 may comprise two upper opposed longitudinal members 14 interconnected to two upper opposed lateral members 16. The upper longitudinal and lateral members 14, 16 may be referred to as an upper structure. The main frame 12 may also have two lower opposed longitudinal members 14 interconnected to two lateral opposed members 16 having the same configuration as the upper structure discussed above. The lower longitudinal and lateral members 14, 16 may be referred to as a lower structure. The upper structure and the lower structure may be stacked upon each other and supported by four vertical members 18 interconnecting respective joints of the upper and lower structures. The main frame 12 may house a gantry manufacturing center 20 (see FIG. 4) and a blank positioning system which will cooperate with each other to fabricate the surfboard from a surfboard blank or foam blank.

The blank positioning system may be disposed within the main frame 12. Also, the gantry manufacturing center 20 may be slideably attached to a rear side of the main frame 12. The main frame 12 may be supported upon a plurality of casters 22 attached to a bottom of the frame to facilitate movement of the surfboard vending machine 10 around a shop floor. The casters 22 may swivel to permit the surfboard vending machine 10 to be traversed about the manufacturing floor. Additionally, the casters 22 may be locked to prevent movement thereof once the surfboard vending machine 10 has been positioned on the manufacturing floor.

The blank positioning system may comprise two blank suction gripper assemblies 24 (see FIG. 5 which illustrates a right blank suction gripper assembly 24) and a linear measurement system for determining positions of the blank suction gripper assemblies 24 along the x-axis. A first blank suction gripper assembly 24 may be located on a left side of the main frame 12, and a second blank suction gripper assembly 24 (see FIGS. 1 and 5) may be located on a right side of the main frame 12. The blank suction gripper assemblies 24 may be supported within the main frame 12 upon a support member 26. The blank suction gripper assemblies 24 may traverse the longitudinal length of the main frame 12. The support member 26 may be located in the middle of the frame. A plurality of transverse members 28 may be attached to the two lower opposing longitudinal members 14 to support the support member 26. The blank suction gripper assemblies 24 may be traverseable along an X-axis on the support member 26. Each of the blank suction gripper assemblies 24 may be position driven via servo-step motors and ride on a plurality of linear slides. The linear measurement system may be attached to the support member 26 and be operative to determine the X position of the blank suction gripper assemblies 24. During operation of the surfboard vending machine 10, the blank suction gripper assemblies 24 may be traversed in the X-direction along the support member 26 depending on the selected configuration of the surfboard to be fabricated and other factors such as length of the selected board.

Figure 5:
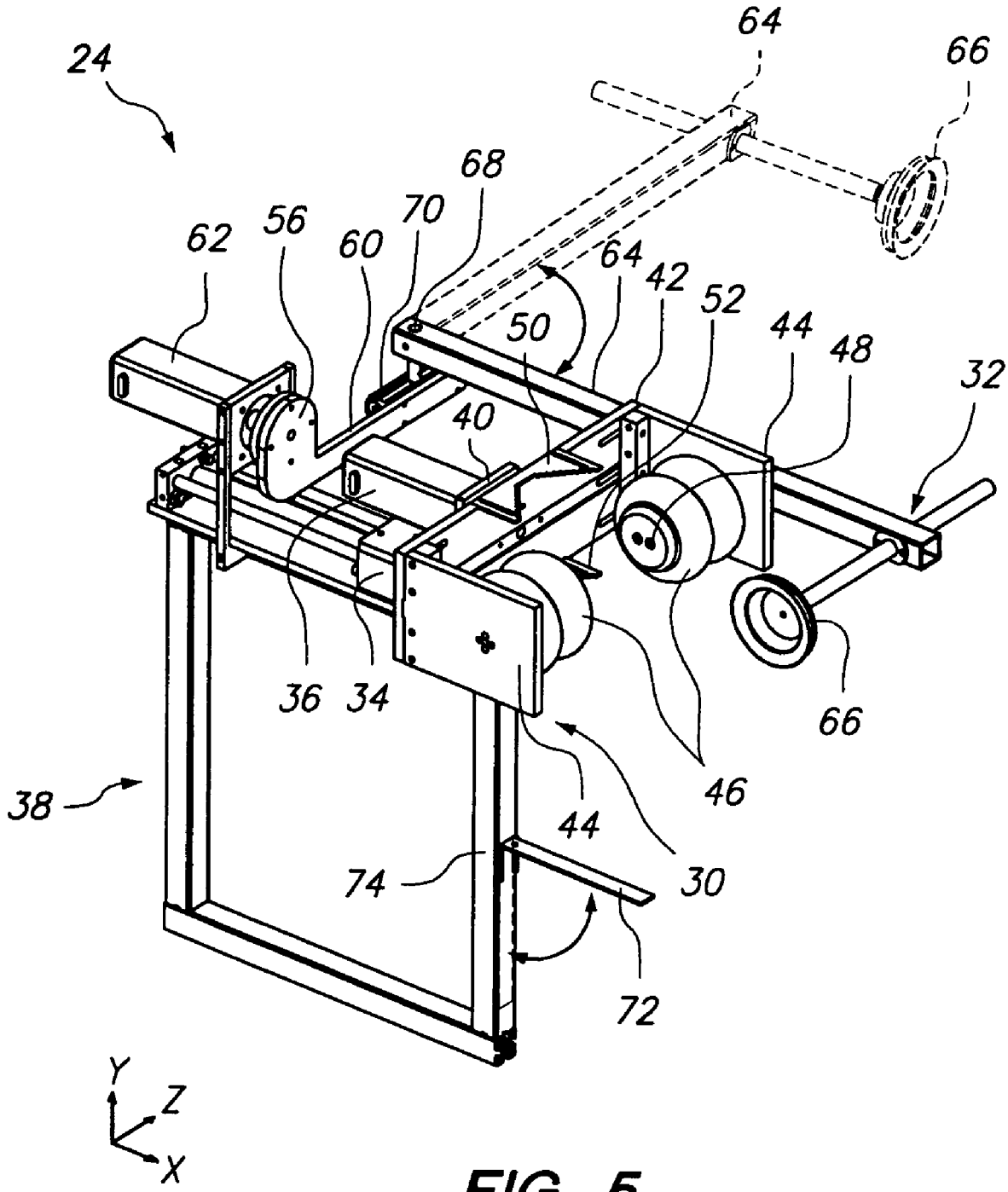
FIG. 5 is a rear perspective view of a blank suction gripper assembly.

As shown in FIG. 5, the blank suction gripper assembly 24 may have a blank gripper 30 and a suction gripper 32. The blank suction gripper assembly 24 may also include a first x-axis actuator 34 for traversing the blank gripper 30 in the positive and negative x-direction and a first rotation motor/actuator 36 for rotating the blank gripper 30 about the x-axis. The first rotation motor/actuator 36 may rotate the blank gripper 30 three hundred sixty (360) degrees. The blank gripper 30 may be attached to a gripper frame 38 of the blank suction gripper assembly 24 via a blank mounting bracket 40. The blank mounting bracket 40 may be connected to a U-shaped bracket 42. The blank gripper 30 may be traversed to an extended position and a retracted position. In the retracted position, the surfboard is not gripped within the blank grippers 30 and clears the surfboard (i.e., the surfboard may be rotated at least one hundred eighty (180) degrees via the suction grippers 32). In the extended position, the surfboard or foam blank is disposed between the tines 44 of the U-shape bracket 42 but not gripped by the blank grippers 30.

Inflatable bellows 46 may be disposed on the tines 44 of the U-shaped bracket 42. The bellows 46 may be air operated via an air pump and extend toward each other or retract away from each other when air is pumped into the bellows 46 or released from the bellows 46, respectively. When air is filled into the bellows 46, the bellows 46 are urged toward each other and ultimately against opposed sides of the foam blank or shaped surfboard (i.e., engaged position). This creates holding pressure such that the foam blank or shaped surfboard may be rotated during fabrication of the surfboard. Each bellow 46 may have a gimbal 48 at a distal end thereof such that the tips may compensate for any curvature of the exterior surface of the shaped surfboard or surfboard blank. When air is removed from the bellows 46, the bellows 46 release the surfboard blank or shaped surfboard (i.e., disengaged position). In review, when the bellows 46 are pumped with air, the bellows 46 are drawn toward each other to the engaged position. With the foam blank or shaped surfboard inserted between the bellows 46, the bellows 46 apply a holding pressure to the foam blank or shaped surfboard.

The first rotation motor/actuator 36 may be attached to a lateral side of the blank mounting bracket 40. The first rotation motor/actuator 36 is operative to pivot the blank gripper 30 about the x-axis. Preferably, the first rotation motor/actuator 36 is operative to pivot the blank gripper 30, and more particularly, the blank at least 180° during fabrication of the surfboard. More preferably, the first rotation motor/actuator 36 may rotate the blank gripper 30 more than 360 degrees about the X axis.

Figure 6:
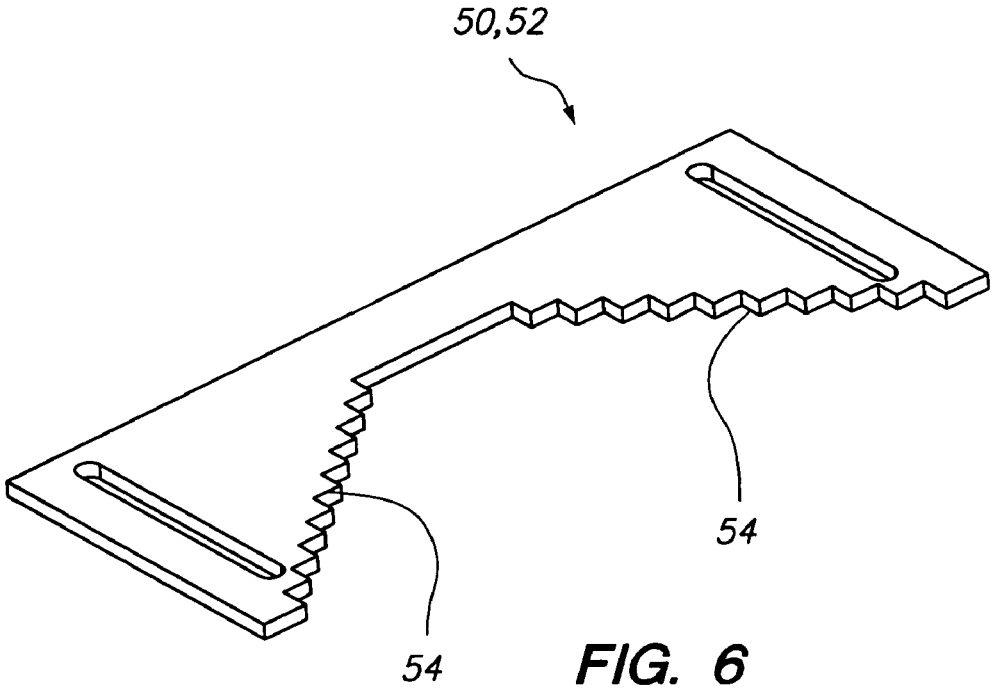
FIG. 6 is a perspective view of an alignment guide.

The upper and lower edges of a base of the U-shaped mounting bracket 42 may have a top alignment guide 50 and a bottom alignment guide 52, as shown in FIGS. 5 and 6. The alignment guides 50, 52 may have a V-shaped configuration which urges the foam blank toward the center of the alignment guides 50, 52 to assist in aligning the foam blank in the z-direction. More particularly, the alignment guides 50, 52 may have a stair stepped V shaped configuration 54.

The suction gripper 32 may be mounted to the gripper frame 38 of the blank suction gripper assembly 24 via a suction mounting bracket 56, as shown in FIG. 5. The suction mounting bracket 56 is traversable in the x-direction on an upper member of the gripper frame 38 of the blank suction gripper assembly 24. For example, the suction mounting bracket 56 may be slideably attached to the upper member 58 and may be fixedly engaged to the upper member 58 by tightening a set screw 59. The suction gripper 32 may have an L-shaped arm 60 (see FIG. 5) which is pivotally mounted to the suction mounting bracket 56. A second rotation motor/actuator 62 may be attached to a lateral side of the suction mounting bracket 56. The second rotation motor/actuator 62 is also attached to the L-shaped arm 60. The second rotation motor/actuator 62 is operative to rotate the L-shaped arm 60 about the x-axis during fabrication of the surfboard. The L-shaped arm 60 on its distal end may have a suction gripper arm 64 which extends past the blank gripper 30. Suction cups 66 may be attached to distal ends of the suction gripper arms 64 and be engageable to the surfboard blank or foam blank. The suction cups 66 and suction gripper arms 64 are not shown in FIGS. 1 and 2 for the purpose of clarity.

The suction gripper arm 64 and the L-shaped arm 60 may be rotateably attached to each other at a joint 68. The suction gripper arm 64 may rotate out and away from the blank grippers 30, as shown by dashed lines of the suction gripper arm 64 in FIG. 5. The suction gripper arm 64 may be rotated out and away from the blank gripper 30 via a third rotation motor/actuator 70 attached to the joint 68.

The suction gripper 32 may also be air operated via an air pump. In particular, a vacuum may be created at the suction cup 66. When the suction cup 66 is placed adjacent to or against the surfboard blank or shaped surfboard, the vacuum creates a vacuum force at the suction cup 66 which holds the surfboard blank or shaped surfboard onto the suction cup 66. The suction cups 66 of both blank suction gripper assemblies 24 grip or engage the surfboard blank or shaped surfboard on the same side of the foam blank or shaped surfboard. In this manner, the surfboard or foam blank may be machined, coated or applied with graphics on the opposed side. The suction grippers 32 and the blank grippers 30 of the blank suction gripper assemblies 24 work in conjunction with each other to suction grip the surfboard such that the shaped surfboard or foam blank may be routed, applied with graphics and coated on both sides of the foam blank or shaped surfboard.

Figure 7:
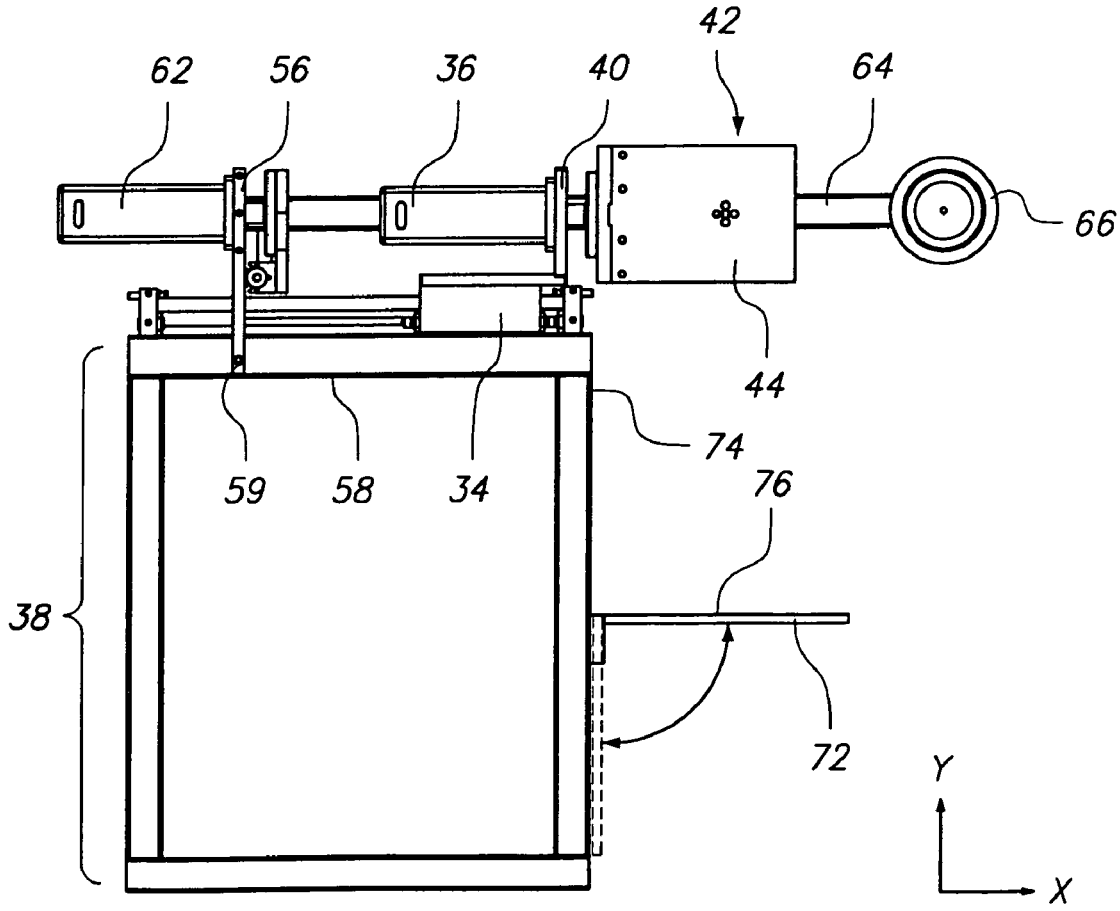
FIG. 7 is a rear view of the blank suction gripper assembly of FIG. 5.

The Y-direction of the surfboard blank is aligned via pedestals 72 which are rotationally attached to the gripper frame 38 of the blank suction gripper assembly 24. In particular, the pedestal 72 may be attached to a forward or inner vertical post member 74 of the gripper frame 38. The pedestal 72 may have a retracted position (i.e., dashed lines) and an extended position (i.e., solid lines), as shown in FIGS. 5 and 7. To align the foam blank in the Y-direction, the pedestal 72 is traversed to the extended position. In the extended position, a landing surface 76 of the pedestal 72 is traversed such that the landing surface 76 is generally parallel to the ground. The landing surface 76 of the pedestal 72 provides a platform on which the foam blank may be rested. After the pedestal 72 is traversed to the extended position, the surfboard blank may be rested on the landing surface 76 to vertically align the surfboard blank in the Y direction. Optionally, the pedestal 72 may be positionally driven via a servo step motor and ride on a linear slide such that the pedestal 72 may be traversed vertically along the vertical post member 74.

The X and Z directions of the surfboard blank are aligned via motion of the blank suction gripper assemblies 24 in the X-direction. As stated above, the U shaped bracket 42 may have top and bottom alignment guides 50, 52 which have a stair stepped V shaped configuration 54. Initially, the blank suction gripper assemblies 24 may be spread apart from each other on opposite sides of the main frame 12. After the user selects the surfboard, the blank suction gripper assemblies 24 may move toward each other to fit the foam blank of the selected surfboard configuration. When the foam blank is disposed between the blank suction gripper assemblies 24 and on the pedestals 72, the inclined surfaces of the top and bottom alignment guides 50, 52 may push the surfboard blank toward its middle in the Z direction as well as the X direction as the blank suction gripper assemblies 24 move toward each other.

Figure 4:
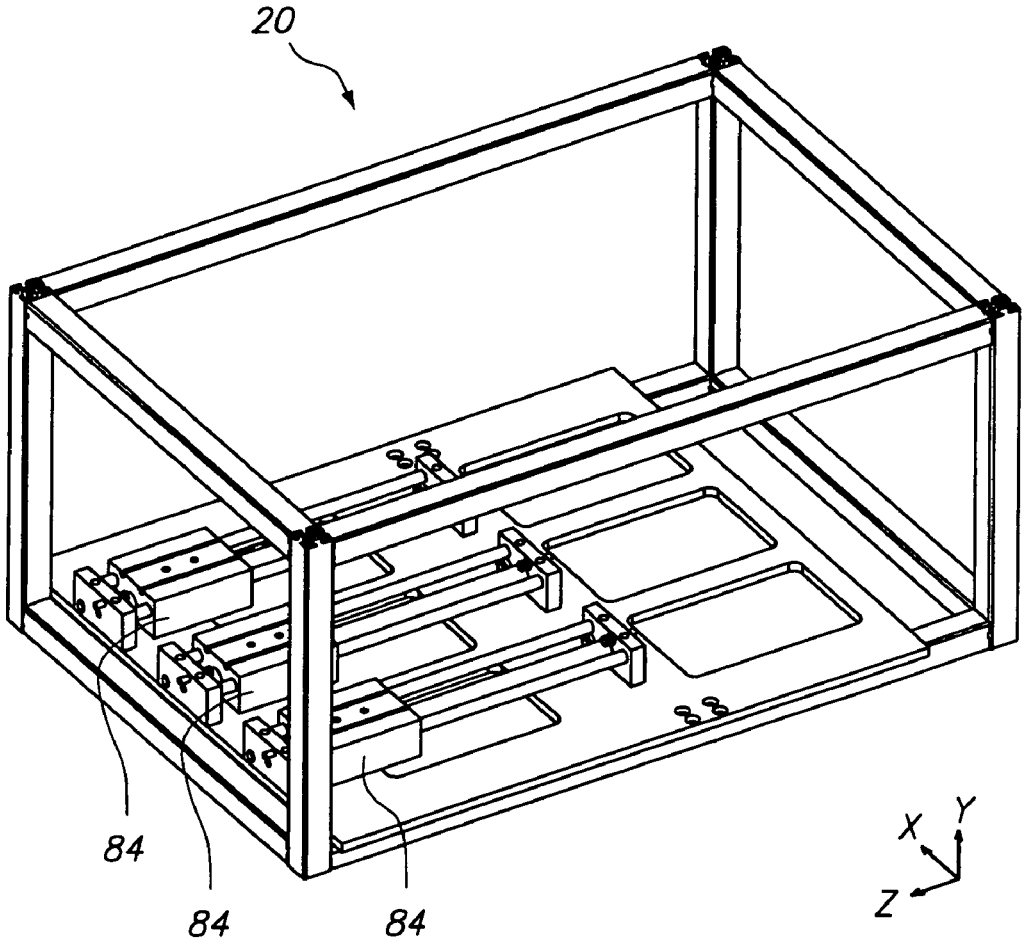
FIG. 4 is a perspective view of a gantry manufacturing center.
Figure 8:
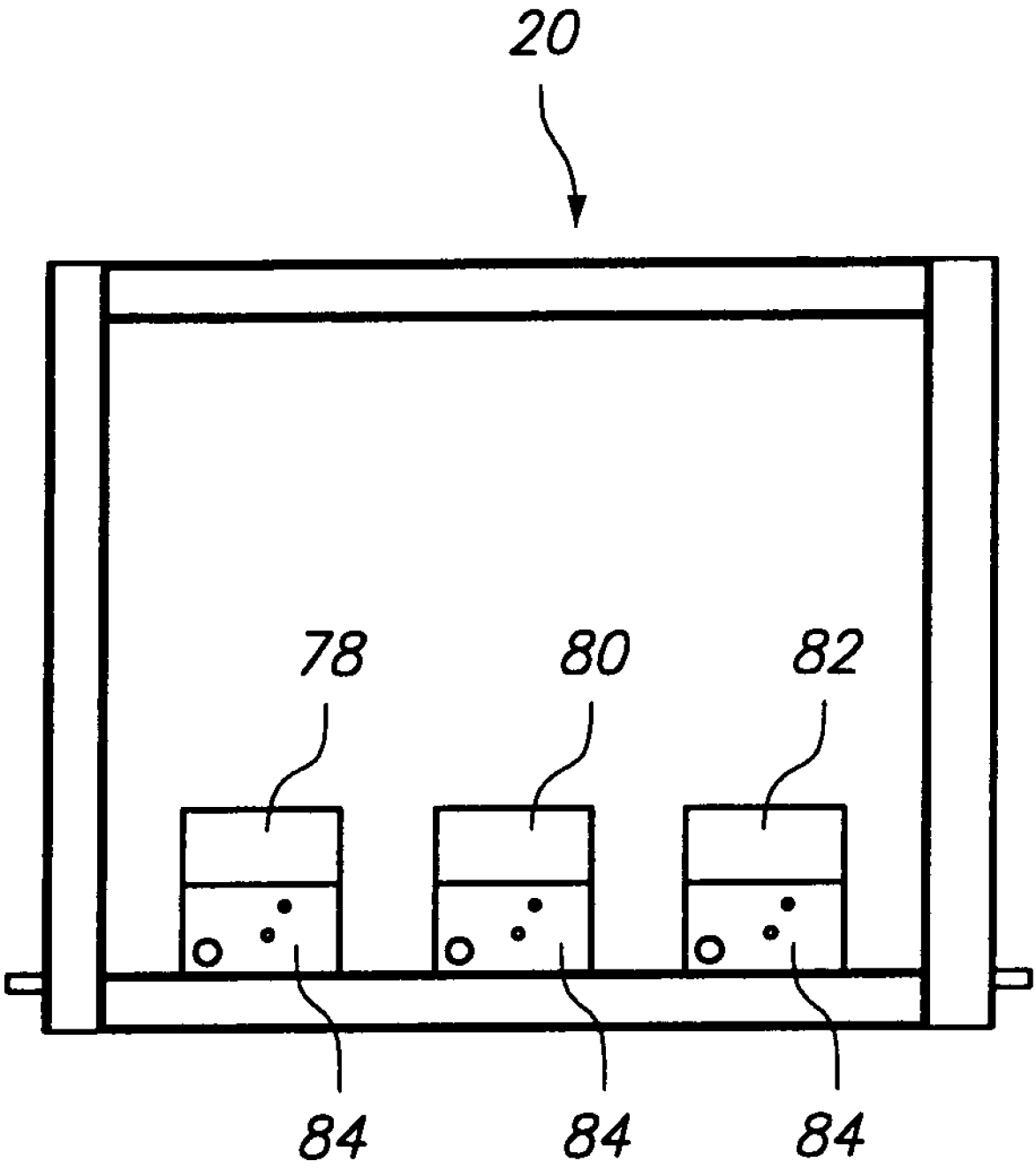
FIG. 8 is a front view of the gantry manufacturing center of FIG. 4.

The gantry manufacturing center 20 may contain a router head 78, a graphics head 80 and a coating head 82, as shown in FIG. 8. The heads 78, 80, 82 may be mounted on linear actuators 84 which are operative to traverse the heads 78, 80, 82 in the z-direction—closer to or away from the foam blank or shaped surfboard. FIG. 4 does not show the heads 78, 80, 82 for the purpose of clarity. The gantry manufacturing center 20 may be enclosed in a sub-frame or box with a side face open to the inner volume of the main frame 12 of the surfboard vending machine 10. In this manner, the heads 78, 80, 82 may have access to the shaped surfboard or the foam blank. The gantry manufacturing center 20 may be attached to two vertical members 86 that are slideably mounted on the upper and lower longitudinal members 14 of the main frame 12. The two vertical members 86 may be mounted on mounting blocks which slide along the upper and lower longitudinal members 14 of the frame. In this manner, the gantry manufacturing center 20 may be positioned in the X-direction. The vertical members 86 may also have linear slides which engage the two vertical members 86 and the gantry manufacturing center 20 to position the gantry manufacturing center 20 in the Y-direction.

The router head 78 may be a Fimec Motorpac model number SM-C54 sold by Ekstromcarlson. The graphics head 80 may be a painting machine sold by Pixation Corporation. For example, the graphics head 80 may be a wire jet SC, wire jet TC, wire jet 5C. The coating head 82 may be a spray gun fabricated by Graco. The coating head may be a spray gun sold by Graco.

The blank positioning system and the gantry manufacturing center 20 may be in electrical communication with an electrical/controls cabinet 88 (see FIG. 2). Also, the electrical/controls cabinet 80 may be in electrical communication with a monitor, or graphical user interface 90. The technician and/or a customer may input relevant data into the surfboard vending machine 10 via the graphical user interface 90. For example, the customer may input their personal data, payment data, board design information and graphics design data which may be saved onto an on-board computer system.

Upon completion of the required data input, a technician may load a surfboard blank (e.g., foam blank) into the surfboard vending machine 10. In particular, the pedestals 72 are traversed to the extended position. The blank suction gripper assemblies 24 are adjusted in the x-direction to fit the length of the surfboard blank of the selected surfboard. The technician may then place the surfboard blank onto the landing surfaces 76 of the pedestals 72 to align the foam blank in the y-direction. The blank suction gripper assemblies 24 may be drawn closer to each other. As they are drawn closer to each other, the top and bottom alignment guides 50, 52 of each of the blank suction gripper assemblies 24 clamp the surfboard blank and align the surfboard blank in the X-direction as well as the Z-direction.

The technician then returns to the monitor (i.e., graphical user interface 90) and confirms with the surfboard vending machine 10 that the surfboard blank is loaded. The blank grippers 30 chuck-up the blank. In particular, the blank grippers 30 are traversed to the extended position such that the surfboard blank is disposed between the tines 44 of the blank grippers 30. The bellows 46 of the blank grippers 30 are traversed to the engaged position by filling or pumping the bellows 46 with air to draw distal ends of the bellows 46 toward each other until the distal ends of the bellows 46 engage the surfboard blank. Since both of the blank grippers 30 of the blank suction gripper assemblies 24 chuck-up the blank, the blank is suspendable via the blank grippers 30. At this position, the blank grippers 30 are at the extended position, the bellows 46 are traversed to the engaged position, and the pedestals 72 are traversed to the retracted position.

The suction grippers 32 are then engaged and secured to the blank. In particular, the suction gripper arms 64 are rotated toward the foam blank such that the suction cups 66 are adjacent to the foam blank. A vacuum is created at the suction cups 66 and the blank is engaged to the suction cups 66. Thereafter, the second and third rotation motors/actuators 62, 70 are fixed such that the blank grippers 30 may release the foam blank and the suction gripper arms 64 may suspend the foam blank. The blank grippers 30 release the surfboard blank by traversing the bellows 46 to the disengaged position (bellows normally biased toward disengaged position) and the blank grippers 30 to the retracted position. At this point, the suction grippers 32 are engaged to a front or first side of the blank. The gantry manufacturing system 20 positions itself adjacent to the blank and the machining head or router head 78 machines or routes a back or second surface of the foam blank according to the shape of the selected surfboard. After the router head 78 shapes the second surface to the shape of the selected surfboard, the blank grippers 30 are traversed to the extended position and the bellows 46 are then traversed to the engaged position. At this moment, the blank grippers 30 have positive engagement with the partially shaped foam blank. Since the second surface of the foam blank is now shaped, the gimbal 48 attached to the distal end of the bellows 46 conforms to the shaped surface. Also, the blank grippers 30 maintain the same position of the foam blank when the suction grippers 32 hand off the foam blank to the blank grippers 30. The suction grippers 32 release the front side of the blank and are traversed to a retracted position or clearance position by rotating the suction arm 64 out and away such that the blank grippers 30 may rotate the surfboard blank 180 degrees.

The blank grippers 30 rotate the surfboard blank 180° 0 to expose the first side of the surfboard blank to the router head 78 (i.e., machining head, etc.). The suction grippers 32 are traversed to the extended position such that the suction cups 66 are adjacent the second side of the foam blank. A vacuum is drawn through the suction cups 66 to engage the surfboard to the suction grippers 32. The gantry manufacturing center 20 is then traversed to the first side of the surfboard blank and the router head 78 is traversed against the first side to shape the first side of the surfboard blank to the configuration of the selected surfboard. The first side of the surfboard blank may be an underside of the surfboard.

At the end of the machining operation, the blank grippers 30 engage the shaped surfboard and the suction grippers 32 are moved to the clearance position. The machine then prompts the technician to input fin boxes 150, 170, 200, 220 (discussed below) and leash plugs into corresponding apertures which are machined into the shaped surfboard during the routing step discussed above. FIGS. 9-16 show four configurations of the fin boxes 150, 170, 200, 220 which are discussed further below. During the machining/routing step, a corresponding fin cavity is formed within the shaped surfboard and exposed through an exterior skin (i.e., first side) of the shaped surfboard to receive the fin boxes 150, 170, 200, 220 and the leash plug. Protective caps may be inserted into the fin apertures to prevent coating material and paint from entering the fin apertures.

After the fin boxes 150, 170, 200, 220 and leash plugs are attached to the shaped surfboard, the suction grippers 32 engage the shaped surfboard. The gantry manufacturing center 20 is then disposed adjacent to the first side of the shaped surfboard. The coating head 82 then coats the first side of the shaped surfboard. The shaped surfboard is then rotated 180° via the blank grippers 30 to then coat the second side of the shaped surfboard. The surfboard is rotated via the same steps discussed above during the machining step. When the shaped surfboard is coated, the coating is applied over the fin box 150, 170, 200, 220 and the leash plug such that the fin box 150, 170, 200, 220 and the leash plug are then fixedly retained within the shaped surfboard. Also, during the coating process, the suction grippers 32 are also slightly rotated and synchronized with the gantry manufacturing center 20 to ensure adequate/consistent coating of the surfboard, especially at rails of the surfboard. During the coating process, a sufficient amount of dry time is allowed to permit the coating to dry.

After the coating step, the print head or graphics head 80 applies a print design to the exterior of the coated surface per the selected design by the customer. In particular, the suction grippers 32 engage the shaped surfboard. The gantry manufacturing center 20, and more particularly, the graphics head 80 is traversed adjacent the shaped surfboard. The graphics head 80 applies a print design on the shaped surfboard. The shaped surfboard may be rotated 180 degrees to apply a graphic design to the opposed side of the shaped surfboard blank. The blank grippers 30 and the suction grippers 32 grip and rotate the shaped surfboard as discussed above in the machining/routing step. Also, the surfboard may be rotated with the suction grippers 32 to achieve the requested graphics design.

After a print design is applied to the shaped surfboard blank, a protective post-graphic spray coating is applied over the graphics to protect the graphics. The customized surfboard may then be presented to the customer.

During the routing/machining step, the coating step, the graphics applying step, the post-graphics protective coating step, the enclosure of the surfboard vending machine 10 is filled with various materials, particulates, and contaminants. Accordingly, the enclosure is fitted with a ventilation system to evacuate the contaminants, particulates or materials that are floating within the enclosure. In this manner, the particulate or contaminants may not adhere to the exterior surface of the shaped surfboard to impair the integrity of the surfboard or detract from the visual appearance of the surfboard. In addition, a vacuum system may compliment the router head to remove debris as the board is shaped.

The various heads 78, 80, 82 used in the gantry manufacturing center 20 may be purged during the various steps discussed above to clear the head.

The surfboard vending machine 10 may also have a plurality of sensors to ensure that the surfboard vending machine 10 is operating properly. For example, the surfboard vending machine 10 may have a plurality of sensors to measure component positions, system pressures, fluid levels, operating temperatures, etc. Also, the main frame 12 of the surfboard vending machine 10 may have an enclosure with a door. The door may in electrical communication with a sensor to determine whether the door is open or shut. The sensors may operate in conjunction with the on-board computer to ensure that the surfboard vending machine 10 is operating properly and safely. For example, proximity sensors may be placed throughout the surfboard vending machine 10 such that the surfboard vending machine 10 is always off when a technician is loading or unloading the foam blank.

The graphical user interface 90 may be a 60" touch screen monitor. The monitor may have a series of prompts to receive input data from the technician or the customer. For example, the technician or customer may input customer specific information (e.g., payment method, contact information, etc.) and also surfboard specific information (e.g., type of board, number of fins, types of waves to be ridden, etc.).

Figure 9:
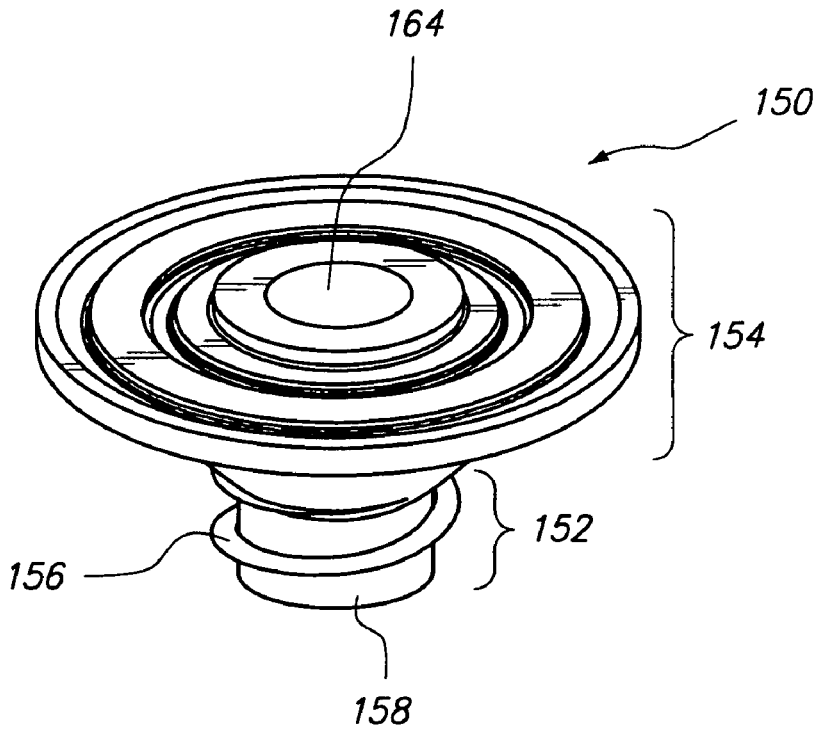
FIG. 9 is a top perspective view of a first version of a fin box.
Figure 10:
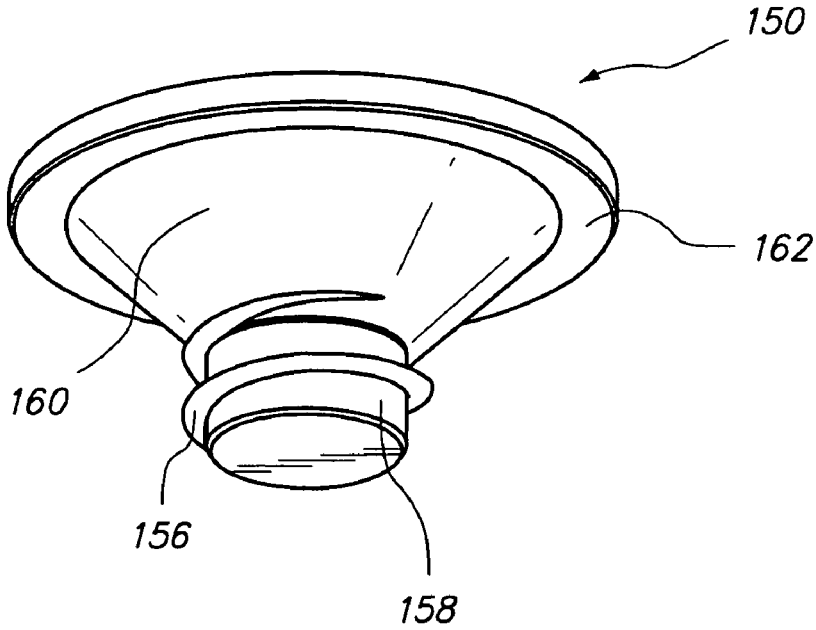
FIG. 10 is a bottom perspective view of the first version of the fin box of FIG. 9.

FIGS. 9-16 illustrate four different versions of the fin box 150, 170, 200, 220. In FIGS. 9 and 10, a first version of the fin box 150 may have a round configuration. The fin box 150 has a lower portion 152 and an upper portion 154 that is coaxially aligned to the lower portion 152. The lower portion 152 may have a coarse pitched thread 156 formed on a cylindrical exterior surface 158 of the lower portion 152. The upper portion 154 may have a frusto conical surface 160 with a radially extending flange 162. During the machining step, the surfboard blank may be formed with a matching fin cavity that fits the frusto conical surface 160, flange 162 and the cylindrical exterior surface 158. To attach the fin box 150 to the surfboard blank, the thread 156 of the fin box 150 may be screwed into the fin cavity. Two fin cavities may be formed in the surfboard such that fin apertures 164 of the fin boxes 150 are approximately 1.5 inches apart from each other to receive corresponding posts of a fin.

Figure 11:
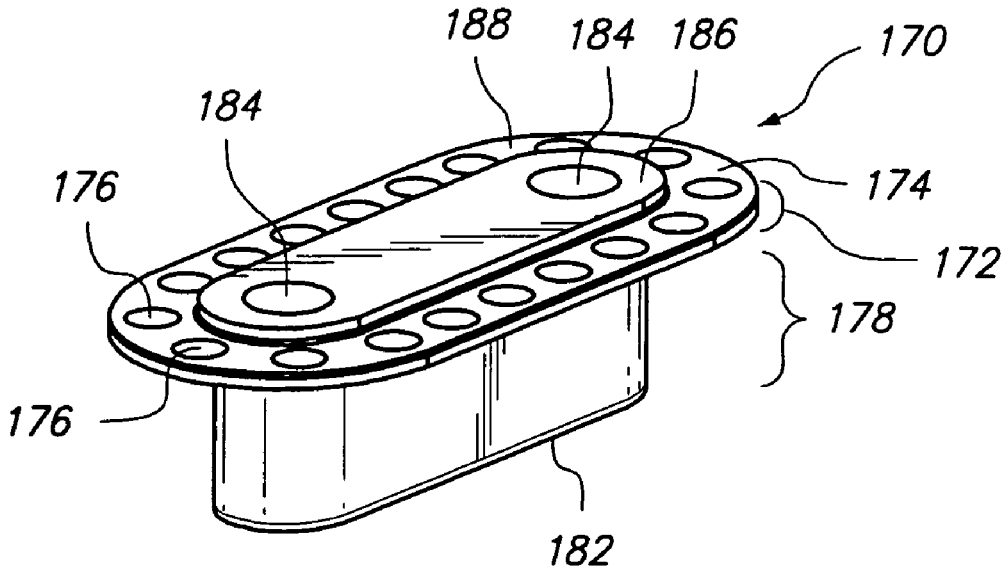
FIG. 11 is a top perspective view of a second version of a fin box.
Figure 12:
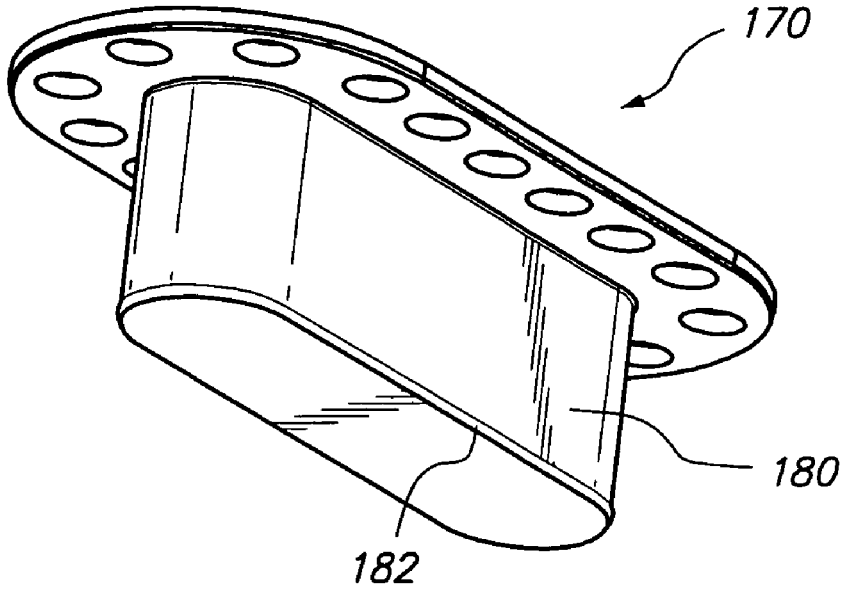
FIG. 12 is a bottom perspective view of the second version of the fin box of FIG. 11.
Figure 12A:
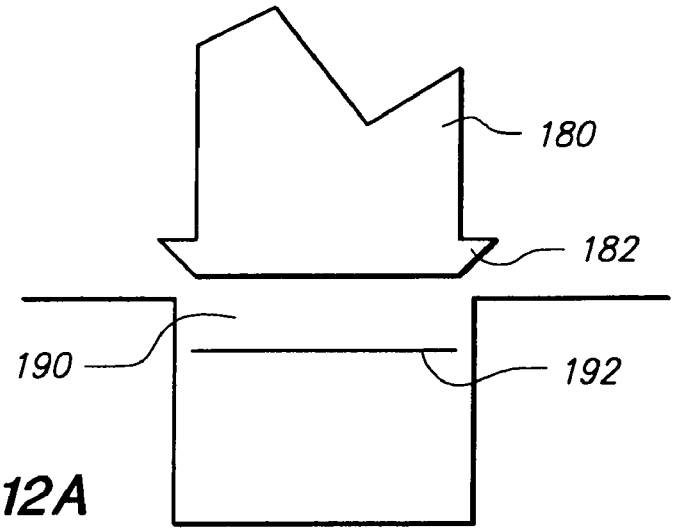
FIG. 12*a* is a cross sectional view of a wedge shaped lip or barb being inserted into a fin cavity of the surfboard.

In FIGS. 11, 12, 12*a*, a second version of the fin box 170 may have an elongated box configuration with rounded distal ends. An upper portion 172 of the fin box 170 may have a radially extending flange 174. The radially extending flange 174 may have a plurality of through holes 176 or apertures formed therethrough about the entire periphery of the flange 174. A bottom portion 178 of the fin box 170 may have a reduced size base 180 with a barb or a wedge shaped lip 182 at a bottom end of the fin box 170, as shown in FIG. 12*a*. It is also contemplated that the reduced sized base may have two or more (e.g., four, etc.) barbs or wedge shaped lips 182. The wedge shaped lip 182 may protrude out laterally about 0.060 inches from the reduced sized base 180. The wedge shaped lip 182 is angled such that the wedge 182 permits the bottom portion 178 to be inserted into the fin cavity 190 machined into the bottom surface of the surfboard but does not permit the withdrawal of the fin box 170 therefrom. Moreover, an adhesive or quick setting epoxy 192 may be applied between the fin box 170 and the fin cavity 190 such that the fin box 170 remains in the fin cavity 190 even though fin box attachment arms 250 (discussed below) are attached to the fin boxes 170 and the surfboard is suspended via such attachment arms 250. The fin cavity 190 formed in the surfboard may have or may be sized slightly smaller than the outer periphery of the wedge lip 182 but slightly larger than the outer periphery of the reduced size base 180, as shown in FIG. 12*a*. The upper portion 172 of the fin box 170 may have a protrusion 186 which is about 0.0050" above a top surface 188 of the radially extending flange 174. In this manner, the coating covers the flange 174 and may be flush with the protrusion. The fin box 170 may have two circular fin apertures 184 disposed through the protrusion 186. These fin apertures 184 may be spaced about 1.5" from each other to receive corresponding posts of the fin.

Figure 13:
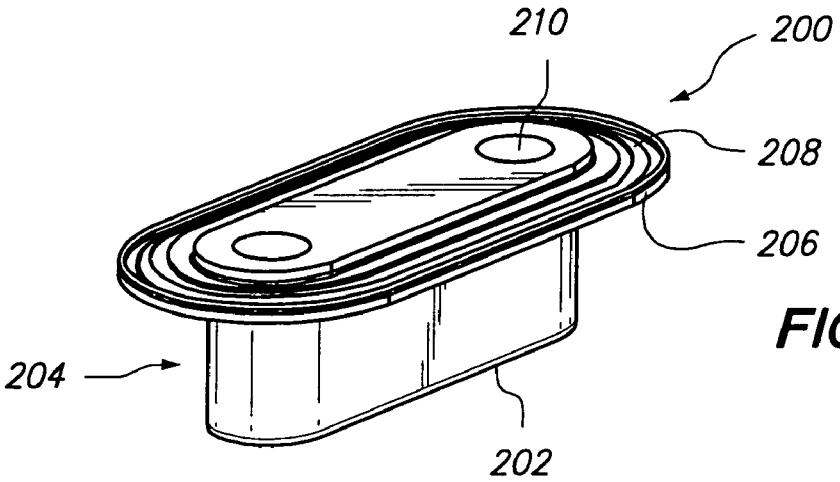
FIG. 13 is a top perspective view of a third version of a fin box.
Figure 14:
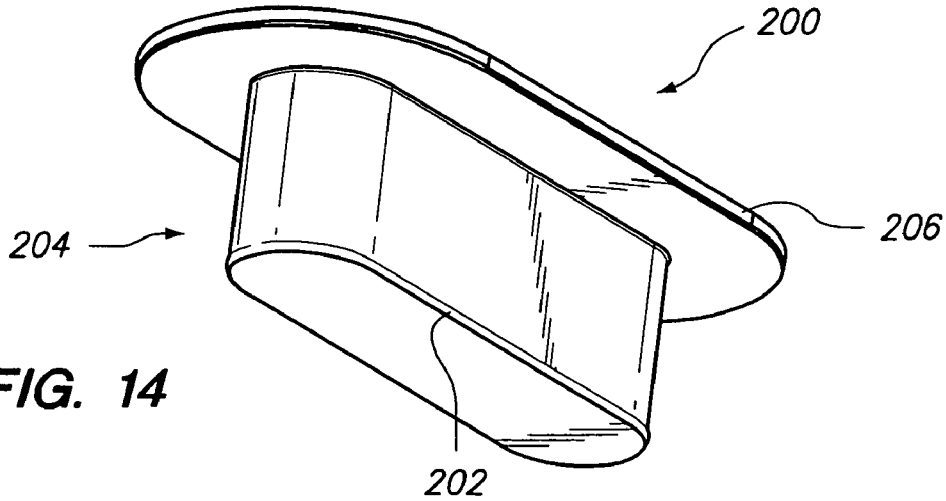
FIG. 14 is a bottom perspective view of the third version of the fin box of FIG. 13.

In FIGS. 13 and 14, a third version of the fin box 200 may have a similar configuration as the second version of the fin box 170. For example, the third version of the fin box 200 may have a wedge shaped lip 202 at a bottom outer periphery of the lower portion 204. The third version of the fin box 200 may have a different configuration as the second version of the fin box 170 in that that the radially extending flange 206 does not have a plurality of through holes; rather, the radially extending flange 206 has at least one annular groove 208 on its top surface.

Figure 15:
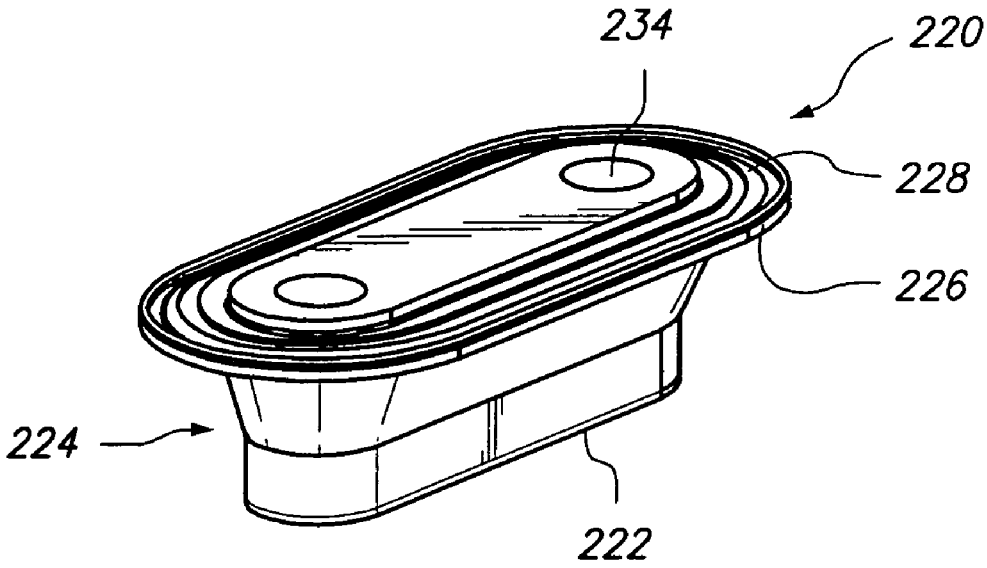
FIG. 15 is a top perspective view of a fourth version of a fin box.
Figure 16:
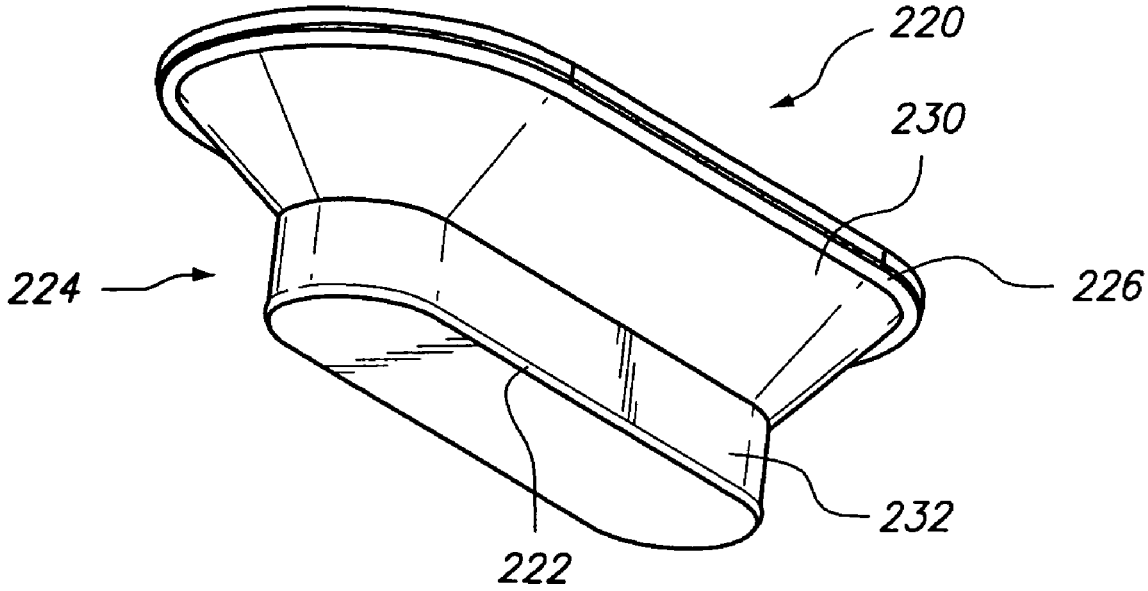
FIG. 16 is a bottom perspective view of the fourth version of the fin box of FIG. 15.

In FIGS. 15 and 16, a fourth version of the fin box 220 may have a similar configuration as the third version of the fin box 200. For example, the fourth version of the fin box 220 may have a wedge shaped lip 222 at a bottom outer periphery of the lower portion 224. Also, a top surface of the radially extending flange 226 may have at least one annular groove 228. However, unlike the third version of the fin box 200, a frusto-conical surface 230 may join the radially extending flange 226 and the base 232.

Figure 17:
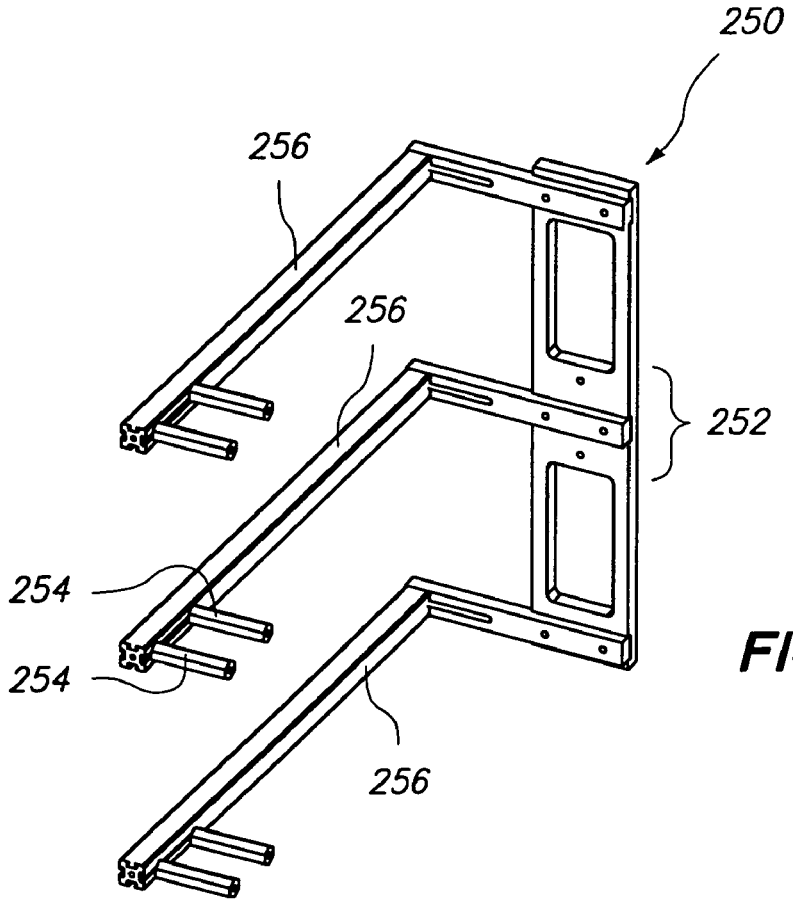
FIG. 17 is a perspective view of a fin box attachment arm.

In another aspect of the surfboard vending machine 10, after the fin boxes 150, 170, 200, 220 and leash plugs are attached to the shaped surfboard, as discussed above, the blank grippers 30 may be replaced with fin box attachment arms 250 (see FIG. 17). By way of example and not limitation, the blank grippers 30 may be attached to the blank mounting bracket 40 via a quick release pin. To change out the blank grippers 30 with the fin box attachment arms 250, the quick release pins are disengaged to release the blank grippers 30 from the blank mounting bracket 40. After the blank grippers 30 are stored away, the fin box attachment arms 250, and more particularly, a base plate 252 of the fin box attachment arms 250 may be attached to the blank mounting bracket 40 with the quick release pins.

Posts 254 may be attached to distal ends of L shaped arms 256 of the fin box attachment arms 250. The posts 254 may be engaged to the fin apertures 164, 184, 210, 234 of the fin boxes 150, 170, 200, 220 which have been attached to the shaped surfboard. After the posts 254 engages the fin apertures 164, 184, 210, 234, the suction grippers 32 may release the shaped surfboard and may be traversed to the clearance position. The shaped surfboard may now be rotated 360 degrees via rotation of the first rotation motor/actuator 36.

After the fin box attachment arms 250 engage the shaped surfboard, the gantry manufacturing center 20 is traversed near the shaped surfboard. The coating head 82 is traversed adjacent to the shaped surfboard. The shaped surfboard may be rotated via rotation of the fin box attachment arms 250 as the coating head sprays a coat over the shaped surfboard. In this manner, an even coat is applied over the shaped surfboard. In contrast, prior art surfboards may have an uneven coat applied to the exterior of the surfboard due to the prior art process of applying the coating to the surfboard. In the prior art, the shaped surfboard is laid on a platform with either the top side or bottom side of the shaped surfboard facing up. The manufacturer coats the entire upward facing side of the surfboard. After the coating has dried, the manufacturer turns the surfboard over to then coat the other side of the surfboard. The prior art process of coating the shaped surfboard produces an uneven overlap of the coating at the rails of the surfboard.

After coating, the graphics and the post graphics coating may be applied to the coated surfboard with the fin cavity attachment arms engaged to the fin boxes.

FIG. 17 illustrates an embodiment of the fin box attachment arm 250 which may comprise three L shaped arms 256 attached to a base plate. The shaped surfboard may also have three corresponding fin boxes attached thereto. Although FIG. 17 illustrates the fin box attachment arm 250 having three L shaped arms 256, it is contemplated that the fin box attachment arm 250 may have only one L shaped arm 256.

Figure 18:
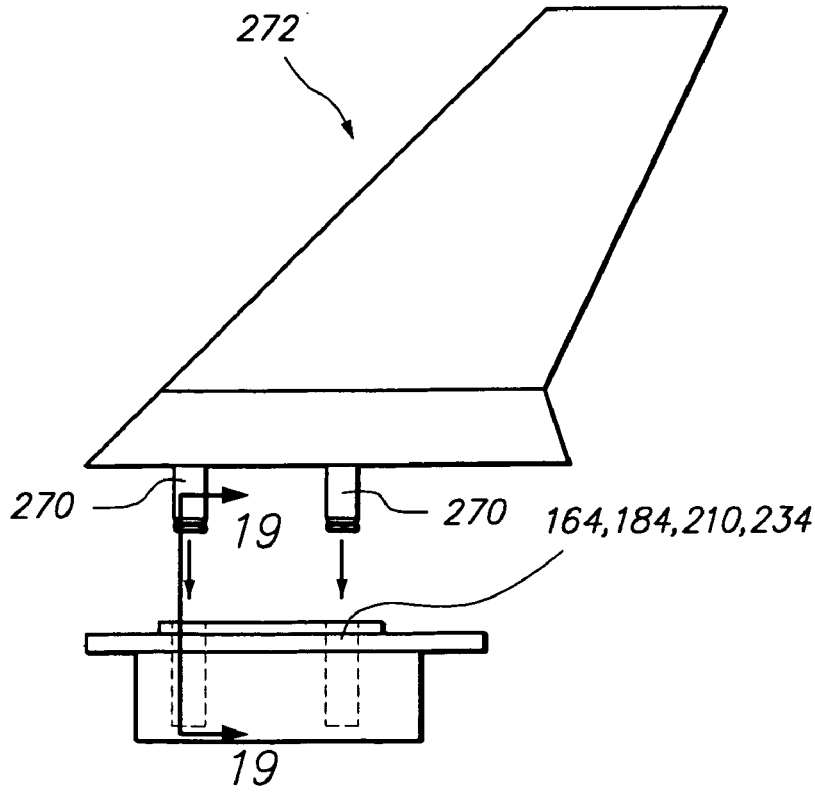
FIG. 18 is a side view of a fin being attached to a fin box, and more particularly, posts of the fin being inserted into the fin apertures of the fin box.
Figure 19:
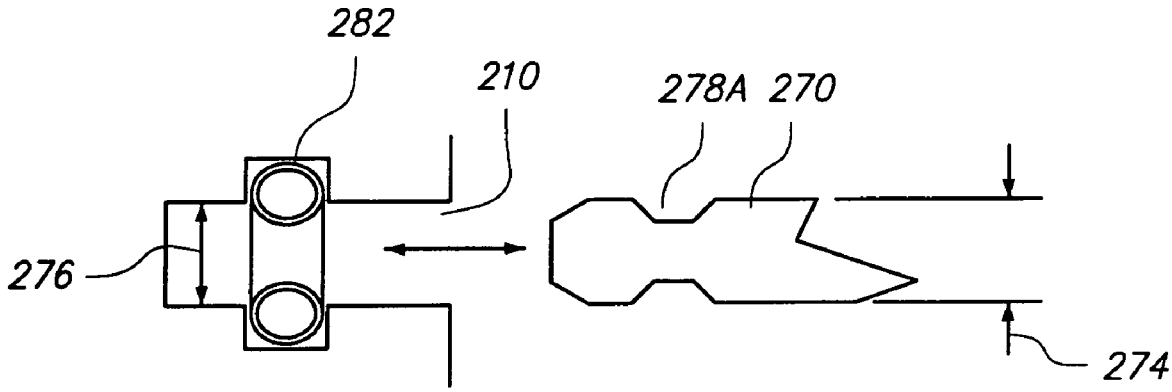
FIG. 19 is a cross sectional view of the post and fin aperture of FIG. 18 illustrating a first version of the attachment between the post and fin aperture.
Figure 20:
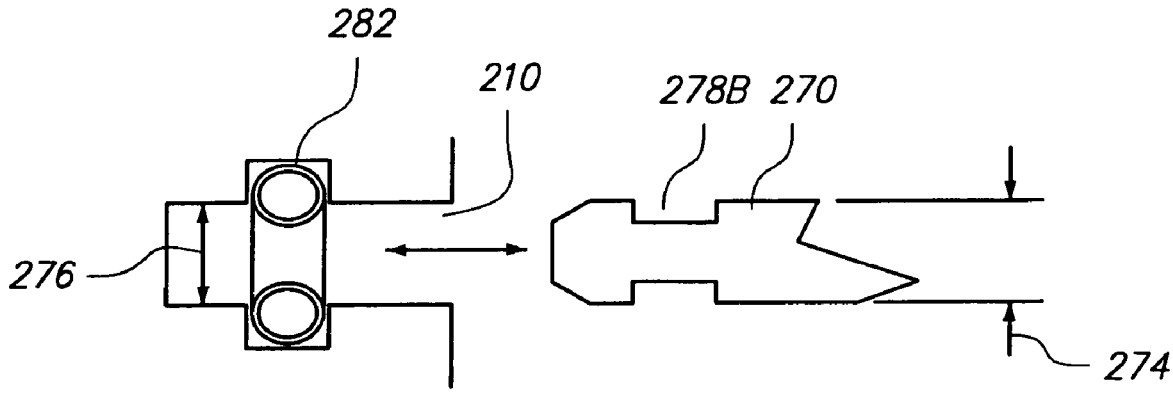
FIG. 20 is illustrates a second version of the attachment between the post and fin aperture.

In another aspect of the surfboard vending machine 10, the posts 270 of the surfboard fin 272 may be attached to the fin apertures 210 of the fin box 200, as shown in FIG. 18. FIG. 18 shows the third version of the fin box 200 but it is contemplated that the manner in which the posts 270 are attached to the fin apertures 210 may be employed in the other versions of the fin box 150, 170, 220. Referring now to FIGS. 19 and 20 which illustrate two versions for attaching the posts 270 of the surfboard fin 272 to the fin aperture 210 of the fin box 200, the post 270 is sized and configured to slide within fin aperture 210 of the fin box 200. In particular, as shown in FIGS. 19 and 20, the outer diameter 274 of the post 270 is smaller than an inner diameter 276 of the fin aperture 210. The post 270 is also formed with a first undercut groove 278*a, b* which circumscribes the post 270. The fin aperture 210 is formed with a second undercut groove 280 which may be aligned to the first undercut groove 278*a, b*. A canted-coil spring 282 may be inserted into the second undercut groove 280. A canted coil spring is a round-wire spring with inclining (canted), elliptical coils that deflect independently when compressed. The entire spring responds whenever any portion of the coil is deflected, permitting uniform loading at each contact point. By way of example and not limitation, a canted-coil spring 282 sold under the trademark BALSEAL Engineering of Foothill Ranch , Calif. may be inserted into the second undercut groove 280.

In FIG. 19, the post 270 may be inserted into the fin aperture 210 and removed therefrom by pushing and pulling the post 270 into and out of the fin aperture 210. The post 270 shown in FIG. 20 may also be inserted and removed from the fin aperture but requires a greater push in force and pull out force compared to the structure shown in FIG. 19. The reason is that the first undercut groove 278*a* shown in FIG. 19 is beveled, whereas the first undercut groove 278*b* shown in FIG. 20 is squared off. In use, the post 270 may be inserted into the fin aperture 210. Upon insertion, the outer diameter 274 of the post 270 pushes the canted coil spring 282 outward until the canted coil spring 282 is seated in the first undercut groove 278*a, b*. The bevel of the first undercut groove 278*a* shown in FIG. 19 permits a user to pull the post 270 out of fin aperture 210 with less force compared to the post 270 and fin aperture 210 shown in FIG. 20.

Although the above discussion focused on the posts 270 of the fin 272, the posts 254 of the L shaped arms 256 of the fin box attachment arms 250 may be fabricated in a similar manner as the posts 270 of the fin 272 for engaging the posts 270 of the fin box attachment arms 250 to the fin box when the blank grippers are switched out with the fin box attachment arms, as discussed above.

In another aspect of the surfboard vending machine 10, the same may provide purchasers with a customized surfboard while the purchaser waits at the retail store. For example, the surfboard vending machine 10 may be placed in a surfboard shop. A purchaser may select a surfboard configuration tailored to his/her personal taste. By way of example and not limitation, the purchaser may select a surfboard configuration for riding big waves. The purchaser may also select a surfboard with multiple fins. After the purchaser has selected the type of board, a technician may load a surfboard blank into the surfboard vending machine 10. The surfboard vending machine 10 may manufacture a surfboard to the purchaser's specification while the purchaser waits at the store. After the surfboard has been manufactured by the surfboard vending machine 10, the technician may inspect the surfboard to ensure that it is to specification. After inspection, the surfboard may be presented to the end user.

More particularly, an accomplished or novice surfer may enter a retail establishment equipped with the surfboard vending machine 10. The surfer may enter his/her personal information (e.g., name, payment method, etc.) and select a surfboard type (e.g., single fin, three fins, board length, etc.) into the surfboard vending machine via the graphical user interface 90. With the surfboard type entered into the surfboard vending machine 10, a technician may load the surfboard vending machine 10 with a surfboard blank. The surfboard vending machine 10 manufactures the selected surfboard expeditiously such that the surfer may browse the retail establishment while the surfer waits for his/her customized surfboard. While the surfer browses the retail establishment, the surfboard vending machine 10 manufactures the surfboard according to the surfer's selected preferences. Within a short period of time, the surfboard vending machine 10 manufactures the surfboard and the retail establishment may present the customized surfboard to the surfer.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of fabricating a surfboard comprising the steps of:

a) loading a surfboard blank in a surfboard manufacturing machine;

b) shaping the surfboard blank with the surfboard manufacturing machine;

c) coating the shaped surfboard with the surfboard manufacturing machine; and d) applying graphics to the coated surfboard with the surfboard manufacturing machine.

2. The method of claim 1 wherein the coating step comprises the steps of:

i) rotating the shaped surfboard; and ii) coating the shaped surfboard simultaneously with the rotating motion of the shaped surfboard.

3. The method of claim 1 wherein the shaping step comprises the steps of:

i) gripping a first side of the surfboard blank with a first gripper to expose a second side of the surfboard blank for shaping the second side;

iii) selectively removing material from the second side of the surfboard blank to shape the second side of the surfboard blank while gripping the first side of the surfboard blank with the first gripper;

iii) gripping the surfboard blank with a second gripper;

iv) releasing the first gripper from the surfboard blank;

v) flipping the surfboard blank;

vi) gripping the second side of the surfboard blank with the first gripper to expose the first side of the surfboard blank for shaping the first side; and vii) selectively removing material from the first side of the surfboard blank to shape the first side of the surfboard blank.

4. The method of claim 3 wherein the steps of gripping the first or second sides of the surfboard blanks with the first gripper comprise the step of creating suction between the first gripper and the first or second sides of the surfboard blank to grip the surfboard blank, and the step of gripping the surfboard blank with the second gripper comprises the step of expanding opposed bellows with the surfboard blank disposed between the opposed bellows.

5. The method of claim 3 wherein the flipping step is accomplished by rotating the second gripper.

6. The method of claim 1 wherein the shaping step comprises the step of machining the surfboard blank.

7. The method of claim 1 wherein the shaping step comprises the step of using a router to shape the surfboard blank.

8. The method of claim 1 wherein the coating step comprises the steps of:

i) attaching a support member to a bottom rear portion of the shaped surfboard to expose the shaped surfaces of the shaped surfboard, the support member being operative to rotate the shaped surfboard more than 180 degrees;

ii) rotating the shaped surfboard with the support member; and iii) coating the shaped surfboard while rotating the shaped surfboard.

9. A surfboard manufacturing machine for shaping a surfboard, the machine comprising:

a surfboard blank;

a stand;

a chuck attached to the stand, the surfboard blank being held by the chuck while the surfboard blank is being shaped;

a machining head adjacent the surfboard blank and operative to selectively remove material from the surfboard blank for shaping the surfboard; and a coating head adjacent the shared surfboard for applying a coat to a shaped surfboard.

10. The machine of claim 9 wherein the machining head is a router.

11. The machine of claim 9 wherein the chuck is operative to rotate the shaped surfboard while the coating head applies the coat to the shaped surfboard.

12. A surfboard manufacturing machine for shaping a surfboard blank, the surfboard blank having a first side and a second side, the machine comprising:

a surfboard blank;

a stand;

a chuck attached to the stand, the surfboard blank being held by the chuck while the surfboard blank is being shaped, the chuck comprising:

a first gripper for holding the surfboard blank while the machining head shapes the surfboard blank;

a second gripper for flipping the surfboard blank after the machining head has shaped one of the first and second sides of the surfboard blank; and a machining head adjacent the surfboard blank and operative to selectively remove material from the surfboard blank for shaping the surfboard.

13. The machine of claim 12 wherein the first gripper is a suction member, and the chuck further comprises an air pump connected to the suction member for creating suction at the suction member for holding the surfboard blank on one of the first and second sides of the surfboard blank.

14. The machine of claim 12 wherein the second gripper is opposed expandable bellows.

15. A surfboard manufacturing machine for shaping a surfboard, the machine comprising:

a surfboard blank;

a stand;

a chuck attached to the stand, the surfboard blank being held by the chuck while the surfboard blank is being shaped;

a machining head adjacent the surfboard blank and operative to selectively remove material from the surfboard blank for shaping the surfboard;

a computer in electrical communication with the machining head and operative to control the machining head, the computer comprising:

a computer readable medium loaded with a library of surfboard shapes; and a button for selecting one of the surfboard shapes within the library of surfboard shapes such that the machining head shapes the blank surfboard in accordance with the selected surfboard shape.

* * * * *